US009682802B2

(12) United States Patent
McDonough

(10) Patent No.: US 9,682,802 B2
(45) Date of Patent: Jun. 20, 2017

(54) GUSSETED POUCHES

(71) Applicant: Exopack, LLC, Spartanburg, SC (US)

(72) Inventor: Brian Joseph McDonough, Battle Creek, MI (US)

(73) Assignee: Coveris Flexibles US LLC, Chicago, IL (US)

( * ) Notice: Subject to any disclaimer, the term of this patent is extended or adjusted under 35 U.S.C. 154(b) by 0 days.

(21) Appl. No.: 14/021,808

(22) Filed: Sep. 9, 2013

(65) Prior Publication Data

US 2014/0072247 A1 Mar. 13, 2014

Related U.S. Application Data

(60) Provisional application No. 61/698,719, filed on Sep. 9, 2012.

(51) Int. Cl.

| | |
|---|---|
| ***B65D 33/00*** | (2006.01) |
| ***B65D 33/20*** | (2006.01) |
| ***B65D 33/24*** | (2006.01) |
| ***B65D 75/00*** | (2006.01) |
| ***B65D 75/58*** | (2006.01) |
| ***B65D 33/22*** | (2006.01) |
| ***B65D 33/25*** | (2006.01) |
| *B65D 30/08* | (2006.01) |

(52) U.S. Cl.

CPC ..... *B65D 33/007* (2013.01); *B65D 33/20* (2013.01); *B65D 33/22* (2013.01); *B65D 33/24* (2013.01); *B65D 33/243* (2013.01); *B65D 33/2508* (2013.01); *B65D 75/008* (2013.01); *B65D 75/5805* (2013.01); *B65D 31/02* (2013.01); *B65D 2313/02* (2013.01); *B65D 2575/586* (2013.01)

(58) Field of Classification Search

CPC B65D 33/2591; B65D 31/10; B65D 33/2508; B65D 75/008; B65D 33/007; B65D 33/20; B65D 33/22; B65D 33/24; B65D 33/243; B65D 75/5805; B65D 31/02; B65D 2313/02; B65D 2575/586; B31B 19/90

USPC ..... 383/61.1, 65, 120, 121, 210.1

See application file for complete search history.

(56) References Cited

U.S. PATENT DOCUMENTS

| | | | | |
|---|---|---|---|---|
| 4,912,616 | A * | 3/1990 | Van Erden | B65D 33/2508 383/65 |
| 5,480,230 | A * | 1/1996 | May | B65D 33/20 383/203 |
| 6,361,209 | B1 * | 3/2002 | LaRue | B65D 33/2591 383/10 |
| 6,874,935 | B2 * | 4/2005 | Edelman | B65D 33/2591 383/120 |
| 7,182,512 | B2 * | 2/2007 | Bois Henri | B31B 19/90 383/120 |

(Continued)

*Primary Examiner* — Peter Helvey
(74) *Attorney, Agent, or Firm* — Stoel Rives LLP

(57) ABSTRACT

A pouch can include a first wall, a second wall, and a lower gusset that extends from each of the first and second walls. The pouch can further include an upper gusset that extends from at least the first wall. The pouch can further include a seal region at an upper end of the pouch. The seal region can be opened to yield an opening through which the contents of the pouch can be accessed. The opening can be at least partially defined by the upper gusset and/or the upper gusset can define a pocket that can maintain external debris therein as the opening is expanded.

23 Claims, 12 Drawing Sheets

(56) References Cited

U.S. PATENT DOCUMENTS

| | | | | |
|---|---|---|---|---|
| 7,186,025 | B2 * | 3/2007 | Shepard | B31B 19/90 383/104 |
| 7,635,222 | B2 * | 12/2009 | Plourde | B31B 19/90 383/200 |
| 7,896,548 | B2 * | 3/2011 | Crunkleton | B65D 33/14 383/104 |
| 7,988,359 | B1 * | 8/2011 | Sussman | B65D 33/08 383/10 |
| 8,414,188 | B2 * | 4/2013 | Koesters | B65D 33/10 383/104 |
| 8,540,427 | B2 * | 9/2013 | Steele | B65D 31/10 383/120 |
| 8,777,486 | B2 * | 7/2014 | Miyake | 383/100 |
| 2004/0131285 | A1 * | 7/2004 | Shepard | B31B 19/90 383/120 |
| 2008/0008404 | A1 * | 1/2008 | Brauer | B65D 31/10 383/61.1 |
| 2009/0245699 | A1 * | 10/2009 | Steele | B65D 33/2575 383/210.1 |
| 2009/0297074 | A1 | 12/2009 | Adams | |

* cited by examiner

GUSSETED POUCHES

CROSS-REFERENCE TO RELATED APPLICATIONS

This patent application claims priority to U.S. Provisional Patent Application No. 61/698,719 entitled GUSSETED POUCHES, filed on Sep. 9, 2012, which is incorporated herein by reference in its entirety.

BACKGROUND

The present disclosure relates generally to pouches, and more particularly to pouches for containing food items. The pouches can differ from previous pouches in significant and beneficial ways, such as discussed more fully herein.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Numerous pouch configurations are known for food items, such as cereal, crackers, candies, etc. In some instances, the pouches may be used primarily as a liner, and additional packaging may be used. For example, in some known cereal configurations, an outer box can contain a pouch within which a cereal is contained. The pouch may be flimsy, as compared with the box, such that the box may be used to stand the cereal item on a shelf. In other instances, the pouch may constitute stand-alone packaging. Various arrangements for single-use, single-serving, or small-portion pouches are also known, such as for use with cereal, snacks, or other food items. In certain of such arrangements, the pouches are contained within boxes, whereas in others, the pouches are of a stand-alone variety. Each previously known pouch can suffer from one or more drawbacks. Embodiments disclosed herein can address, ameliorate, resolve, and/or eliminate one or more of such drawbacks and/or can have beneficial features, as compared with prior art pouches. Such improvements will be apparent from the present disclosure.

Figure 1:
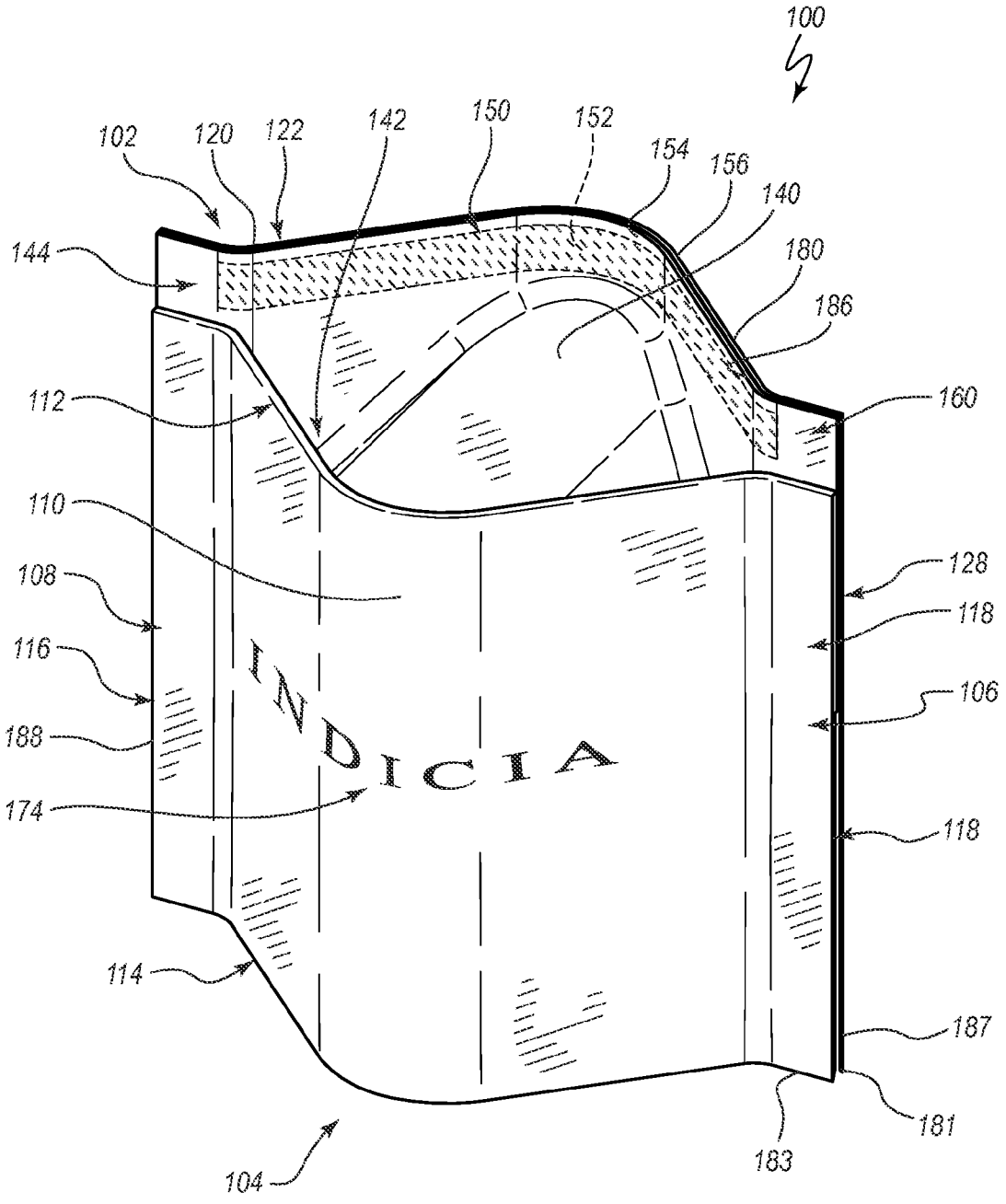
FIG. 1 is a perspective view of an embodiment of a pouch in a sealed state.
Figure 2:
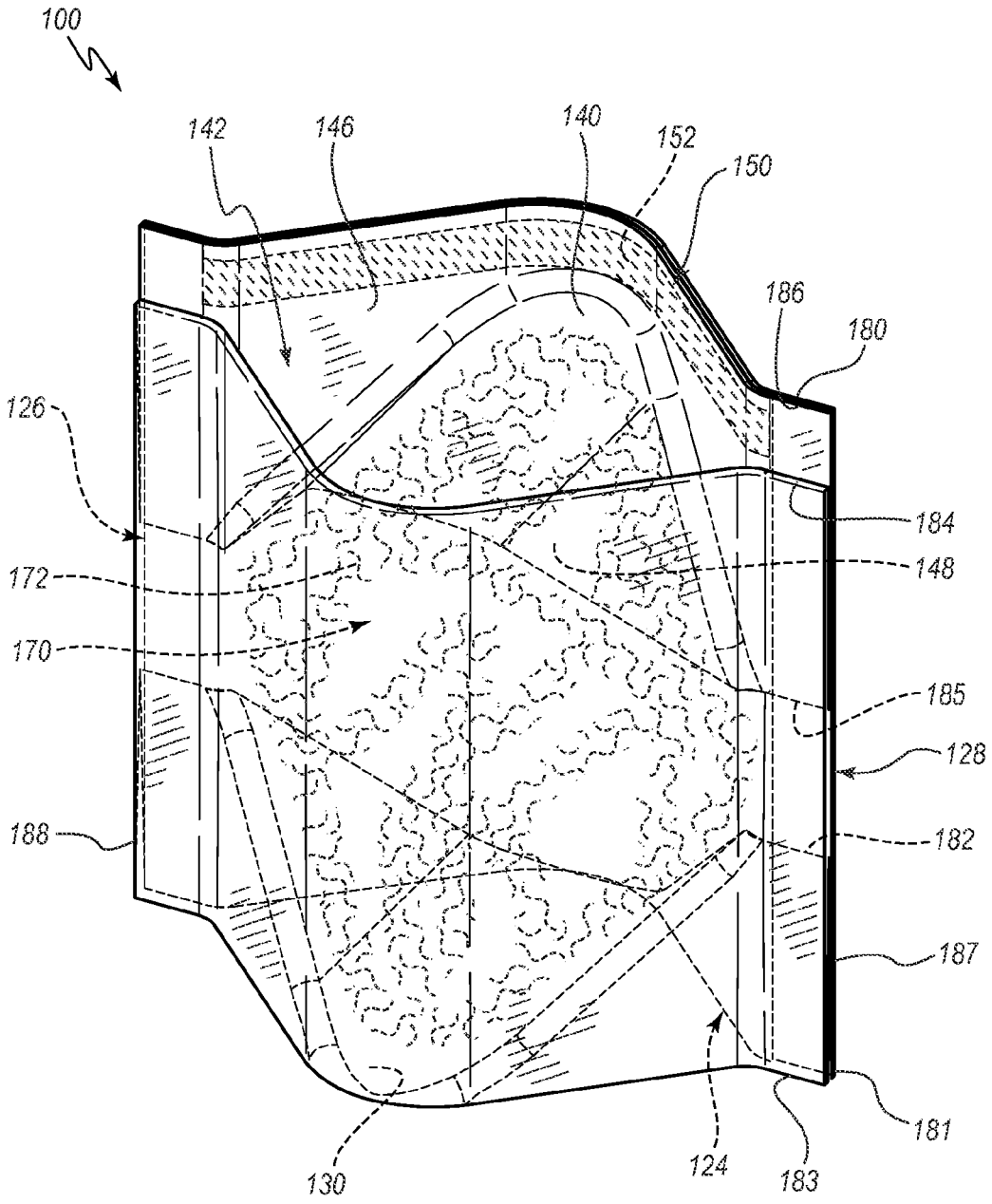
FIG. 2 is another perspective view of the pouch of FIG. 1 in the sealed state, wherein portions of the pouch that are hidden from view in FIG. 1 are shown in phantom.

FIGS. 1 and 2 depict an embodiment of a bag, package, or pouch 100 that is in a sealed state. FIG. 1 is a standard perspective view in which an exterior surface of the pouch 100 is visible. FIG. 2 is a similar perspective view, except that portions of the pouch 100 and contents of the pouch that would normally be obscured from view by at least a front wall of the pouch 100 are shown in phantom.

The pouch 100 may be used to contain a food product 172 of any suitable variety. In various embodiments, the food product 172 can comprise cereal, crackers, candies, etc. As will be apparent from further discussion below, in various embodiments, the pouch 100 can be used advantageously as a single-use, single-serving, or small-portion packaging for cereal. For example, in some embodiments, the pouch 100 may be used as a bowl when the pouch is opened, such as by pouring milk into the pouch 100 over cereal contained within the pouch 100. In other or further embodiments, the pouch 100 may be reclosable. Embodiments of the pouch 100 can be configured to prevent foreign material (e.g., debris, dust, microbes) that may be positioned at an exterior surface of the pouch 100 from being pushed into an interior of the pouch 100 during opening of the pouch 100.

The pouch 100 can have an upper end 102, a lower end 104, and two opposing lateral ends 106, 108. The pouch 100 can include a front wall 110, a rear wall 120, a lower gusset 130, and an upper gusset 140. Directional terms, such as "front," "rear," "upper," "lower," etc., are used herein with respect to the orientation shown in FIG. 1. These terms are used for the sake of convenience and are not necessarily intended to be limiting. For example, the front wall 110 could in fact be printed with material that is more suitable for a rear wall of a packaging (e.g., printed with nutritional information), such that the front wall 110 in fact serves as a rear wall. The front and rear walls 110, 120 may also be referred to herein as front and rear walls 110, 120, respectively.

Each of the front wall 110 and the rear wall 120 can include an upper end 112, 122, a lower end 114, 124, and opposing lateral ends 116, 118, 126, 128, respectively. The lower gusset 130 can extend from the front wall 110 and the rear wall 120. Stated otherwise, the lower gusset 130 can be attached or otherwise directly coupled with each of the front and rear walls 110, 120. The lower gusset 130 can comprise a folded piece of material that is capable of transitioning from a flattened state to an expanded state. The lower gusset 130 can be configured to permit the lower ends 114, 124 of the front and rear walls 110, 120 to be spaced apart from each other to expand the lower end 104 of the pouch 100, as shown in the configuration depicted in FIGS. 1 and 2. The lower ends 114, 124 of the front and rear walls 110, 120 can serve as a base on which the pouch 100 rests. Expansion of the lower gusset 130 can serve to stabilize the base.

The upper gusset 140 can similarly comprise a folded piece of material that is capable of transitioning from a flattened state to an expanded state. The upper gusset 140 can be configured to permit the upper ends 112, 122 of the front and rear walls 110, 120 to be spaced apart from each other to expand the upper end 102 of the pouch 100, as shown in the configuration depicted in FIGS. 1 and 2. The upper gusset 140 can extend from the front wall 110, such as by being attached or otherwise directly coupled with the front wall 110. As further discussed below, the upper gusset 140 can be attached or otherwise directly coupled to the rear wall 120 when the pouch 100 is in a closed or sealed state. Accordingly, the upper gusset 140 can extend from each of the front and rear walls 110, 120 when the pouch 100 is in the closed or sealed state.

As further discussed below, in the illustrated embodiment, the upper gusset 140 differs somewhat from the lower gusset 130. For example, the upper gusset 140 can include an extension or flange 144 at an upper/rearward end thereof, such that the upper gusset 140 is slightly larger than the lower gusset 130. However, in some embodiments, the flange 144 may be connected to the rear wall 120 in such as manner that the flange 144 is generally fixed relative to the rear wall 120 prior to opening of the pouch 110. Accordingly, although the upper and lower gussets 140, 130 may be slightly different sizes, portions of the gussets 140, 130 that are moveable or expandable, relative to both the front and rear walls 110, 120, may be identically sized such that the upper and lower ends 102, 104 of the pouch 100 may be expandable by the same amount.

In other embodiments, the upper and lower gussets 140, 130, and/or the movable portions thereof, relative to both the front and rear walls 110, 120, may be different sizes to permit the upper and lower ends 102, 104 of the pouch 100 to be expandable by different amounts. In some embodiments, the upper end 102 may be expandable by a greater amount than the lower end 104, which can allow the upper end 102 to have a relatively larger opening when the upper gusset 140 is moved to an open state (such as discussed further below with respect to FIG. 3), which may provide more ready access to the contents of the pouch 100. However, in some embodiments, permitting the upper end 102 of the pouch 102 to expand by a greater amount may permit a larger quantity of the food product to be present toward the upper end 102 of the pouch 100, which may make the pouch top-heavy or more prone to tipping. Certain embodiments may balance the size of the upper gusset 140 relative to the lower gusset 130 based on at least these factors. In various embodiments, a ratio of the movable or expandable portions of the upper and lower gussets 140, 130 (relative to both the front and rear walls) is no more than about 0.5, 0.75, 1.0, 1.25, 1.5, 1.75, or 2.0 to 1.

The upper gusset 140 can define a pocket 142. The pocket 142 can be defined, in particular, by the exterior surface of the upper gusset 140. The pocket 142 can be a cavity or depressed or recessed region, which can be positioned between the front and rear walls 110, 120. When the pouch 100 stands upright on its lower end 104, for example, the pocket 142 can be prone to collecting dust or other debris. Moreover, where the pocket 142 is defined by an exterior surface of the pouch 100, the pocket 142 is not sterile and may be prone to being contaminated, such as with microbes. Accordingly, in some embodiments, it may be desirable to avoid pushing any portion of the upper gusset 140 into an interior of the pouch 100. Stated otherwise, in some embodiments, it may be desirable to avoid moving any of the contents of the pocket 142 into an interior of the pouch 100. As further discussed below with respect to FIG. 3, a rearward portion 146 of the upper gusset 140 can serve as a barrier between the pocket 142 and an interior of the pouch 100 to maintain any debris that may be present in the pocket 142 prior to opening the pouch 100 within the pocket 142 as the pouch 100 is opened.

With continued reference to FIGS. 1 and 2, the pouch 100 can include a seal region 150. The seal region 150 can include the flange 144 portion of the upper gusset 140 and the upper end 122 of the rear wall 120, which may also be referred to as an extension of the rear wall 120. The seal region 150 can include a seal 152 that closes (e.g., in an airtight, liquid-tight, and/or hermetic fashion) the pouch 100. The seal 152 may be of any suitable variety. For example, in some embodiments, the seal 152 comprises a heat seal. As further discussed below, in some embodiments, the heat seal 152 can be formed using a peelable sealant layer, and the heat seal 152 can be a peelable heat seal. In other embodiments, the seal 152 may be formed via ultrasonic welding or any other suitable method. Accordingly, although the following discussion primarily refers to the seal 152 as a "heat seal," it should be understood that the seal 152 can comprise any other suitable variety of seal, and may desirably be readily opened by an end user. In some embodiments, such as that depicted in FIGS. 1 and 2, the seal 152 may be a fin seal.

In some embodiments, the seal 152 is configured for opening without reclosing. For example, in certain of such arrangements, the pouch 100 may be particularly well suited for single-use packages. In other embodiments, the seal 152 and/or other portions of the seal region 150 may be reclosable. For example, as discussed further below (e.g., with respect to FIGS. 11 and 12), in some embodiments, seal region 150 and/or the seal 152 can comprise one or more of a zipper and a resealable adhesive. For example, in some embodiments, the seal region 150 can include a non-reclosable heat seal 152 and can further include a reclosable zipper. Certain of such embodiments may be particularly well suited for multi-use packages.

In some embodiments, the seal region 150 can comprise pull tabs 154, 156 that can be gripped by a user to aid in opening or unsealing the seal 152. In the illustrated embodiment, the heat seal 152 does not extend all the way to the top edges of the rear wall 120 and the upper gusset 140. The pull tabs 154, 156 thus are defined by the uppermost ends of the rear wall 120 and the upper gusset 140 that are not heat sealed to each other.

As shown in FIG. 2, an interior surface of each of the front and rear walls 110, 120 and the upper and lower gussets 130, 140 can cooperate to define a cavity 170 into which a food product 172 is received. The cavity 170 may be sealed shut in an airtight fashion to preserve the freshness of the food product 172.

Figure 3:
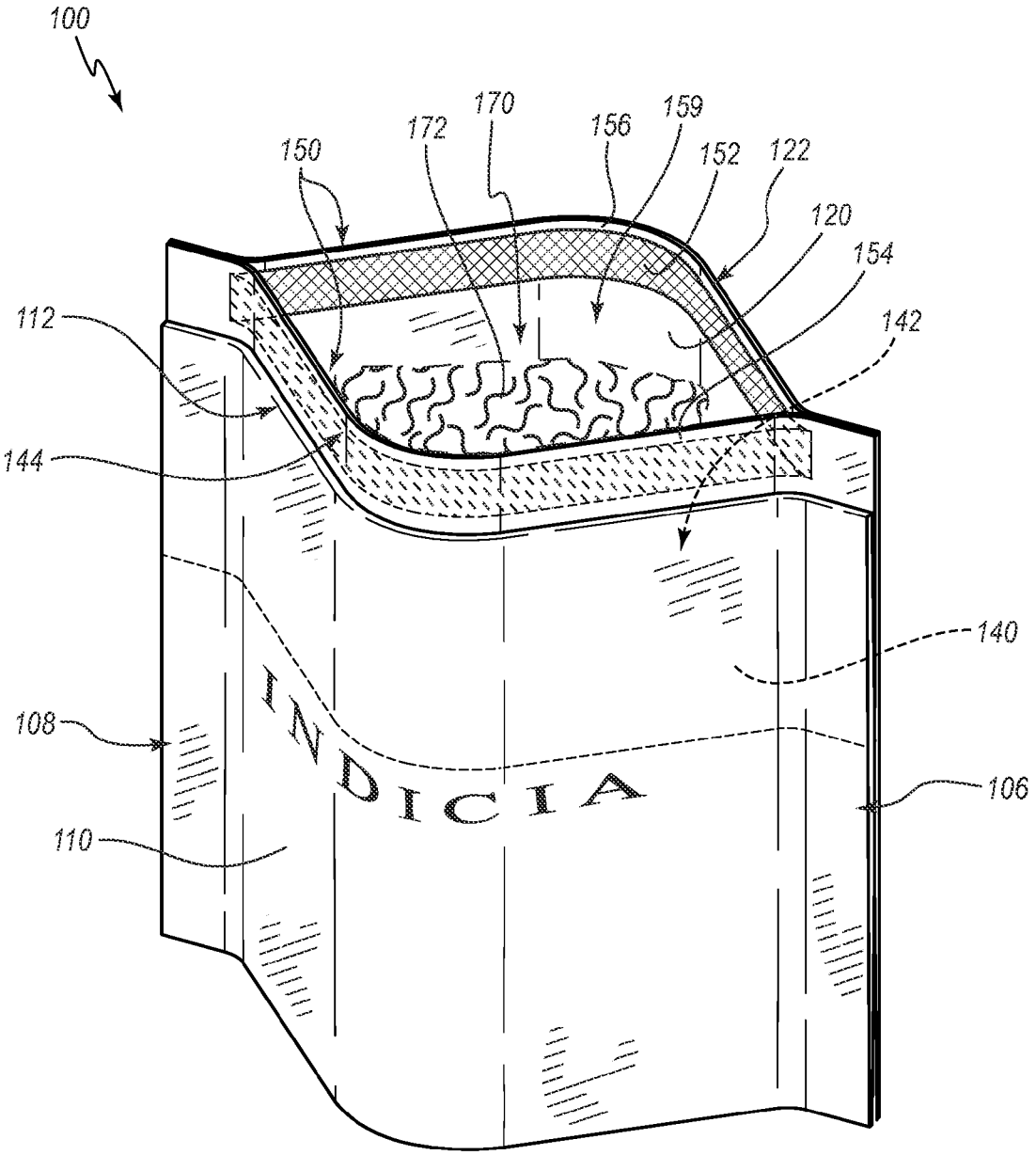
FIG. 3 is another perspective view of the pouch of FIG. 1 in an open or unsealed state.

FIG. 3 depicts the pouch 100 in an open or unsealed state. The pull tabs 154, 156 have been used to pull apart the upper ends of the flange 144 portion of the upper gusset 140 and the upper end 122 of the rear wall 120. As can be appreciated in each of FIGS. 1-3, at least a portion of the seal region 150 can be higher than (e.g., extend upwardly past) the upper end 112 of the front wall 110. In particular, the flange 144 of the upper gusset 140 and the upper end 122 of the rear wall 120, which include the heat seal 152, can be higher than the upper end 112 of the front wall 110. This extended region may be referred to as an extension 160 of the pouch 100. In some embodiments, the extension 160 may be folded over (e.g., backward and downward) when the pouch 100 is in the sealed state.

Arrangements that include an extension 160 can provide a visual cue to a user as to which portion of the pouch 100 can be used to open the pouch 100. Such an arrangement may also facilitate opening of the pouch 100, in that the front wall 110 can provide adequate clearance for a hand of a user to move the upper gusset 140 into proximity with the front wall 110 without obstruction from the front wall 110. In some embodiments, the extension 160 may include a tab that can be used in displaying the pouch 100. For example, in some embodiments, the pull tabs 154, 156 may be longer than those shown in FIG. 3 and may be sufficiently tall to include a centrally positioned hole (not shown) above the heat seal 152 through which a peg may be inserted so that the pouch 100 may hang on the peg. In other embodiments, a tab formed of a separate piece of material (not shown), such as a relatively stiff plastic, may be adhered to the upper end 122 of the rear wall 120 or to the extension 144 of the upper gusset 140. The separate tab may include a hole for receiving a peg. In various embodiments, a difference in height between the rear wall 120 and the front wall 110 (e.g., a height of the extension 160) can be no greater than about 0.25, 0.5, 0.75, 1.0, 1.5, or 2.0 inches. In other embodiments, the front and rear walls 110, 120 can be approximately the same height, as discussed below with respect to FIG. 9.

As previously discussed, the exterior surface of the upper gusset 140 can define a pocket 142 and the interior surface of the upper gusset 140 can define an upper end of the cavity 170 when the pouch 170 is sealed closed. As the pouch 100 is opened, the interior surface of the upper gusset 140 can cooperate with the interior surface of the rear wall 120 to define an opening 159 through which the contents of the cavity 170 can be accessed. As can be appreciated from FIG. 3, the opening 159 can be expanded by collapsing the upper gusset 140. For example, the rearward portion 146 of the gusset 140 can be moved away from the rear wall 120 into proximity to a forward portion 148 of the gusset 140 and the front wall 110. Stated otherwise, as the opening 159 is expanded, the gusset 140 can be collapsed by bringing opposing portions 146, 148 of the upper gusset 140 together. Stated otherwise, the exterior surfaces of the opposing portions 146, 148 of the upper gusset 140 may be brought into closer proximity with each other. The pocket 142 can become narrower as the opening 159 is expanded.

As previously mentioned, the rearward portion 146 of the upper gusset 140 can serve as a barrier between the pocket 142 and the cavity 170. As the opening 159 is expanded, the barrier can maintain any debris that may be present in the pocket 142 within the pocket, and thus can prevent the debris from entering the pouch 110 through the opening 159. In the illustrated embodiment, the rearward portion of the upper gusset 140 includes an extension that increases the height of the barrier. Accordingly, the barrier extends beyond the upper edge of the front wall 110 when the opening 159 is fully expanded, as shown in FIG. 3.

In certain embodiments, an integrity of one or more materials of which the upper gusset 140 is formed is maintained throughout an opening event such that any contents of the pocket 142 are prevented from passing through the one or more materials into the cavity 170. For example, the upper gusset 140 may be formed from a material that comprises one or more layers, and at least one of those layers can remain intact throughout an entire opening event. This can prevent any openings from forming in the upper gusset 140 through which any debris that has collected in the pocket 142 can enter into the cavity 170 and into contact with the food product 172.

The pouch 100 can include printed indicia 174 of any suitable variety. Certain embodiments of the pouch 100 can desirably omit a fin seal and/or any other seal from the front and rear walls 110, 120, which would otherwise interrupt such printed indicia 174.

In some embodiments, the pouch 100 can be configured to naturally remain in an open configuration, such as that depicted in FIG. 3, once the rearward portion 146 of the upper gusset 140 has been approximated to the forward portion 148 and the opening 159 has been fully expanded. In some embodiments, a material of which the pouch 100 is formed is sufficiently flexible to allow the outer surface of the rearward portion 146 of the upper gusset 140 to be inverted from the rearwardly bowed or concave shape of FIG. 1, where it is sealed to the rear wall 120, to the forwardly bowed or convex shape of FIG. 3, where it is approximated to the forward portion 148. Moreover, as previously mentioned, and as discussed further below with respect to FIGS. 4-8, in some embodiments, the upper gusset 140 is formed from a folded piece of material, which can include the forward portion 148 at one side of a fold 185 and the rearward portion 146 at an opposite side of the fold 185. In some embodiments, the fold 185 is trapped by and sealed between the front and rear walls 110, 120 at the lateral ends 106, 108 of the pouch 100. When the pouch 100 is filled and in the sealed position, the fold 185 may not be present at the central region of the upper gusset 140 due to the expanded state of the gusset 140 and/or the presence of the food product 172. However, the fold 185 is continuously present in at least the lateral ends 106, 108 of the pouch 100. When the rearward portion 146 of the upper gusset 140 is collapsed toward the front wall 110 so as to open and fully expand the opening 159, the fold 185 may naturally return along a full lateral width of the upper gusset 140. The lateral sides 106, 108 of the pouch 100 may be relatively rigid, as compared to more central portions of the upper gusset 140 that are spaced from the lateral sides 106, 108. This comparative rigidity may be provided by heat seals along the lateral ends 106, 108. This rigidity of the lateral ends 106, 108 may bias the lateral sides of the upper gusset 140 inwardly. The inward bias may aid in maintaining the upper gusset 140 in a fully open position. For example, in some embodiments, the material of which the pouch 100 is formed may be sufficiently stiff to respond to the inward bias provided by the lateral ends 106, 108 of the pouch so as to maintain the upper gusset 140 in the inverted position shown in FIG. 3. The pouch 100 may include other or further features that aid in maintaining the opening 159 in an open position, such as those discussed below with respect to FIGS. 10A and 10B.

In some embodiments, maintaining the upper gusset 140 in an open position can be a desirable feature. For example, having the upper gusset 140 automatically stay in the open configuration can omit any extra effort that would otherwise be expended in manipulating the opening 159 to keep it open. The contents of the pouch 100 may be accessed, for example, using a single hand when the pouch 100 is resting on a surface, or, as another example, one hand may be used merely to hold the pouch 100 (e.g. at the base of the pouch) while another hand is used to access the contents of the pouch 100. In some instances, the stay-open functionality can facilitate access to the cavity 170 for purposes of ready snacking. In other instances, milk, water, or other liquid can be introduced into the pouch 100 through the opening to mix with the food product 172. The pouring step can be facilitated by a stay-open feature. Further, subsequent accessing of the contents of the pouch 100, such as with a spoon, can also be facilitated. The pouch 100 can, for example, function as a bowl.

FIGS. 4-8 depict various stages of an illustrative method for manufacturing the pouch 100. In some embodiments, the pouch 100 can be formed on a form fill seal (FFS) machine, such as a vertical FFS (VFFS) machine. The FFS machine may be configured to form the pouch 100 from a sheet of web material that may be delivered from a roll. In other embodiments, the pouch 100 may be partially formed into an open receptacle or bag-like structure. Thereafter, the semi-formed pouch may be filled and sealed shut in a separate process. In various embodiments, standard equipment can be used in forming the pouch 100, but the equipment may be modified and/or augmented in order to achieve various features of the pouch 100.

Figure 4:
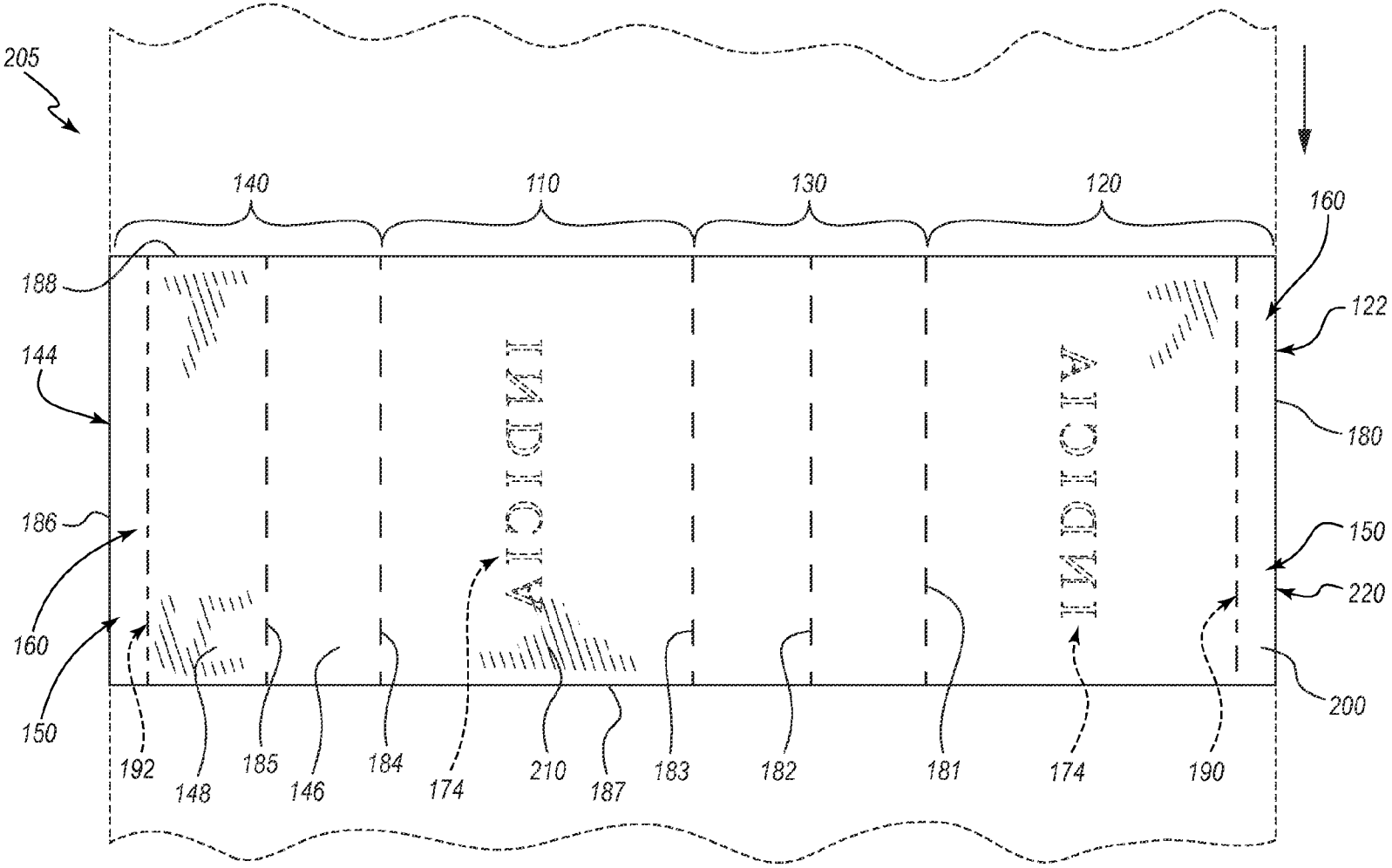
FIG. 4 is a plan view of an embodiment of a web of material, wherein a segment of the web of material that can be used in forming a pouch, such as the pouch of FIG. 1, is shown in solid lines.

With reference to FIG. 4, in some embodiments, the pouch 100 may be formed from a web of material 200 that is fed into the FFS equipment from a roll stock 205. The web material 200 may be of any suitable variety. A stiffness of the web material 200 may be selected based on any suitable factors, such as the stay-open functionalities discussed above. For example, in some instances, it can be desirable to select a stiffness of the web material 200 such that the material is sufficiently rigid to hold a pouch shape when the pouch 100 is in the sealed state and to hold an open-mouth bowl shape when the pouch 100 is in the open state, and yet is sufficiently flexible to readily transition from the sealed state (e.g., pouch shape) to the open state (e.g., bowl shape).

In some embodiments, the web material 200 comprises a single-layer film or a multi-layer film. The web material 200 can comprise a laminate or a coextruded material. In some embodiments, the inner and/or outer surfaces and/or layers of the web material 200 can be heat sealable. In some embodiments, an inner layer comprises heat-sealable polyethylene and/or heat-sealable polypropylene, although any suitable material is contemplated. In other or further embodiments, an outer layer comprises heat-sealable polyester and/or heat-sealable polypropylene, although any suitable material is contemplated. In some embodiments, the outer layer has a higher melting point than the inner layer. Some embodiments may include one or more barrier layers of any suitable variety. In some embodiments, the web material 200 is gas- and/or liquid-impervious.

In certain embodiments, the web material 200 comprises a peelable sealant layer 210 as the innermost layer. The peelable sealant layer 210 can be of any suitable variety, and may be configured to form a readily openable peel seal 152 (FIG. 3).

In FIG. 4, a single segment 220 that may ultimately be cut from the roll stock 205 of web material 200 to form a pouch 100 is shown in solid lines. Adjacent portions of the roll stock 205 that may be included in additional segments are shown in broken lines, and a feed direction of the roll stock 205 is depicted by a downwardly directed arrow.

The segment 220 can include portions (110, 130, 140) that will be used to form the front wall 110, the rear wall 120, the lower gusset 130, and the upper gusset 140. The segment 220 can include opposite longitudinal edges 180, 186 and opposite lateral edges 187, 188. Portions of the segment 220 can be folded along fold lines (which are not necessarily physically marked on the segment 220) during formation of the pouch 100. In the illustrated embodiment, five primary fold lines 181, 182, 183, 184, 185 are shown. By way of reference, the edges 180, 186, 187, 188 and the fold lines 181, 182, 183, 184, 185 are also labeled in FIG. 2.

In some embodiments, a fin seal can be formed at the seal region 150, which may include the extension 160 (e.g., the extension or flange 144 portion of the upper gusset 140 and the extension at the upper end 122 of the rear wall 120). The limits of these "extension" portions, which may correspond with fin seal regions, are depicted by broken lines 190, 192. As previously noted, in some embodiments, the extension 160 may be folded along the broken lines 190, 192. For example, in some embodiments, the extension 160 may be folded over (e.g., backward and downward) in a finished pouch 100. The lines 190, 192 thus may also be referred to as secondary fold lines.

The various portions of the segment 220 can be of any suitable dimensions. For example, in some embodiments, a small format pouch 100 may, when devoid of contents and in a flattened state, have a width of about 5.25 inches and a height of about 4.0 inches, and when the cavity 170 of the bag is fully expanded, a maximum distance between the front and rear walls 110, 120 can be about 3.0 inches. Such a pouch 100 can be formed, for example, from a segment 220 having a lateral width (i.e., the distance between the lateral edges 187, 188) of about 5.25 inches and a longitudinal length (i.e., the distance between the longitudinal edges 180, 186) of about 15.0 inches. In certain of such embodiments, the distances between the edge 180 and the line 190 can be about 0.5 inches, between the lines 190 and 181 can be about 4.0 inches, between the lines 181 and 182 can be about 1.5 inches, between the lines 182 and 183 can be about 1.5 inches, between the lines 183 and 184 can be about 4 inches, between the lines 184 and 185 can be about 1.5 inches, between the lines 185 and 192 can be about 1.5 inches, and between the lines 192 and 186 can be about 0.5 inches. The foregoing examples are merely illustrative, as numerous other dimensions and configurations are possible. For example, in some embodiments, large-format pouches may be formed. Certain of such large format bags may have a width of about 10 inches and a height of about 12 inches. Other sizes of the final pouch 100 and dimensions of various portions of the segment 220 are contemplated.

Figure 5:
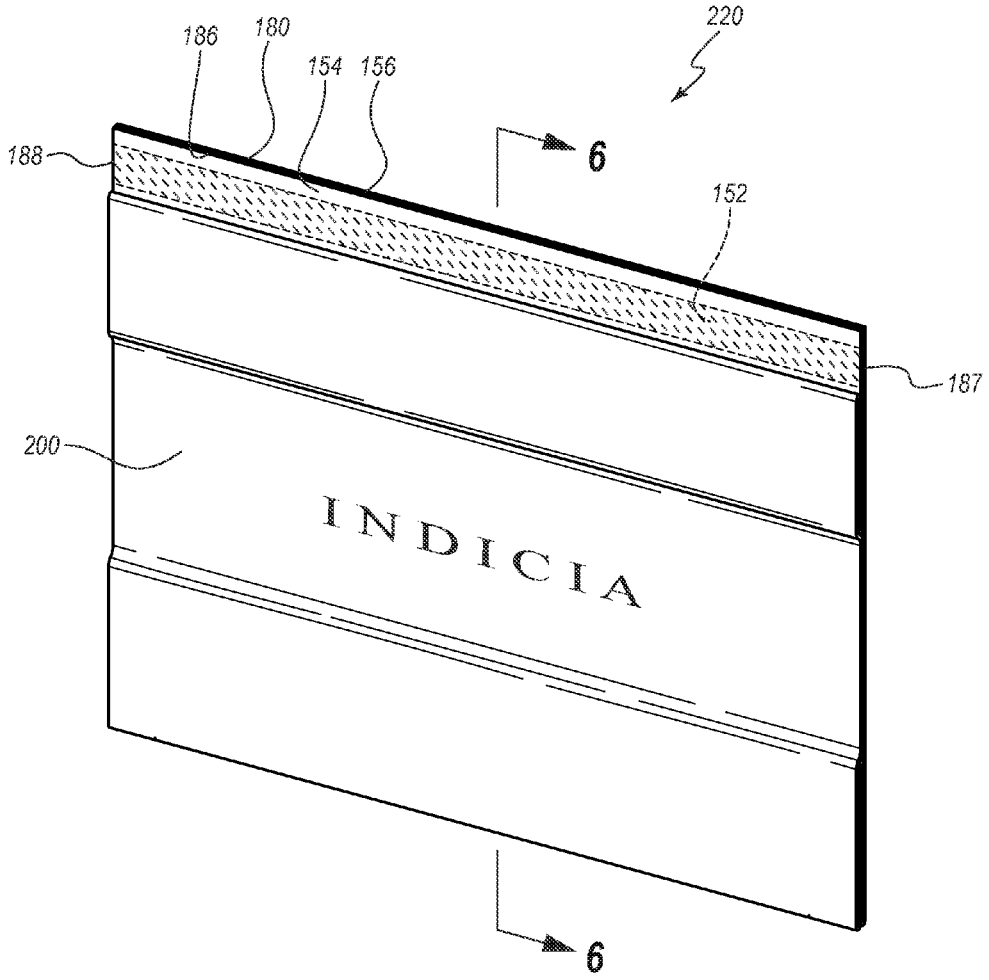
FIG. 5 is a perspective view that depicts a stage in the formation of a pouch from the segment of material shown in FIG. 4, at which stage a peelable fin seal has been formed at two opposing longitudinal ends of the segment.

FIG. 5 depicts another early stage in an illustrative method for forming a pouch 100. At this stage, the segment 220 has been folded along the various fold lines and the longitudinal ends of the segment 220 have been heat sealed together in a fin seal arrangement. In some embodiments, this arrangement can be achieved using VFFS equipment. For example, the segment 220 can be wrapped around a forming collar and the fin seal 152 can be formed by any suitable sealing jaws, such as jaws that impart heat and/or ultrasonic energy to the web material 200. The folds (e.g. along the fold lines 181, 182, 183, 184, 185) may be achieved via the forming collar and/or additional equipment. Accordingly, in some embodiments, the segment 220 may encircle the forming collar at the stage shown in FIG. 5, and thus may not be in the substantially flat configuration depicted in FIG. 5.

The amount of energy imparted to the web material 200 can determine whether the heat seal 152 will be a peel seal that is readily opened or a lock seal that is much stronger and much more difficult, or even impossible to open, without damaging the pouch 100. In the illustrated embodiment, the heat seal 152 can desirably be a peel seal, whereas other seals formed at the lateral ends (discussed below) can be lock seals that have a greater strength than the peel seal.

In the illustrated embodiment, the heat seal 152 is formed in a pattern that extends from one lateral edge 187 to the opposite lateral edge 188. The heat seal 152 does not, however, extend all the way to the longitudinal edges 180, 186, thus leaving the pull tabs 154, 156 unattached to each other. A user thus can grip the pull tabs 154, 156 to open the finished pouch 100.

Figure 6:
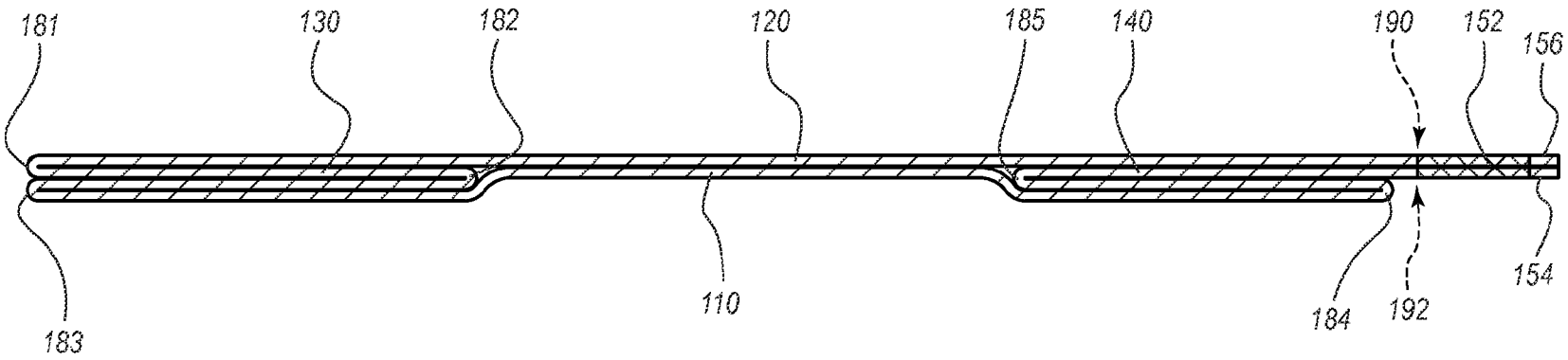
FIG. 6 is a cross-sectional view of the partially formed pouch of FIG. 5 taken along the view line 6-6 in FIG. 5.

FIG. 6 is a cross-sectional view of the segment 220 at the stage depicted in FIG. 5. This view better illustrates the relative positions of the front and rear walls 110, 120, the gussets 130, 140, and the fold lines 190, 192, 181, 182, 183, 184, 185. The heat seal 152 and pull tabs 154, 156 are also shown.

Figure 7:
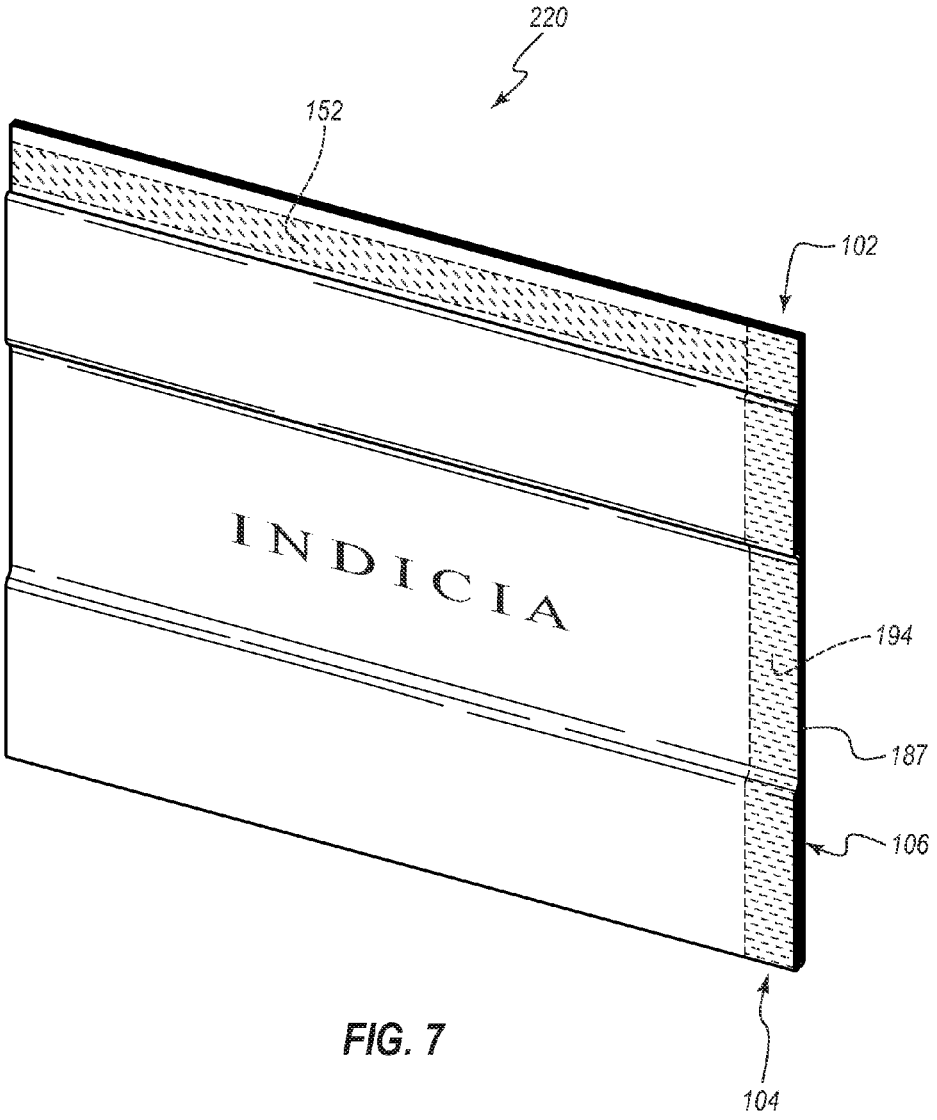
FIG. 7 is a perspective view that depicts another stage in the formation of a pouch from the segment of material shown in FIG. 4, at which stage a lock seal has been formed at a lateral end of the segment.

FIG. 7 depicts another stage of the illustrative formation process after the formation of a lock seal 194 along the lateral end 106. The lock seal 194 extends all the way to the lateral edge 187 of the segment 220, and extends all the way to the edges of the upper and lower ends 102, 104 of what will ultimately become the pouch 100. The lock seal 194 can overlap and strengthen a lateral end portion of the heat seal 152. A greater amount of energy can be imparted to the segment 220 to form the lock seal 194, as compared with the upper seal 152. In some embodiments, the lock seal 194 is formed via heat sealing equipment. Other sealing methods and processes, such as, for example, ultrasonic welding, may also be used.

Figure 8:
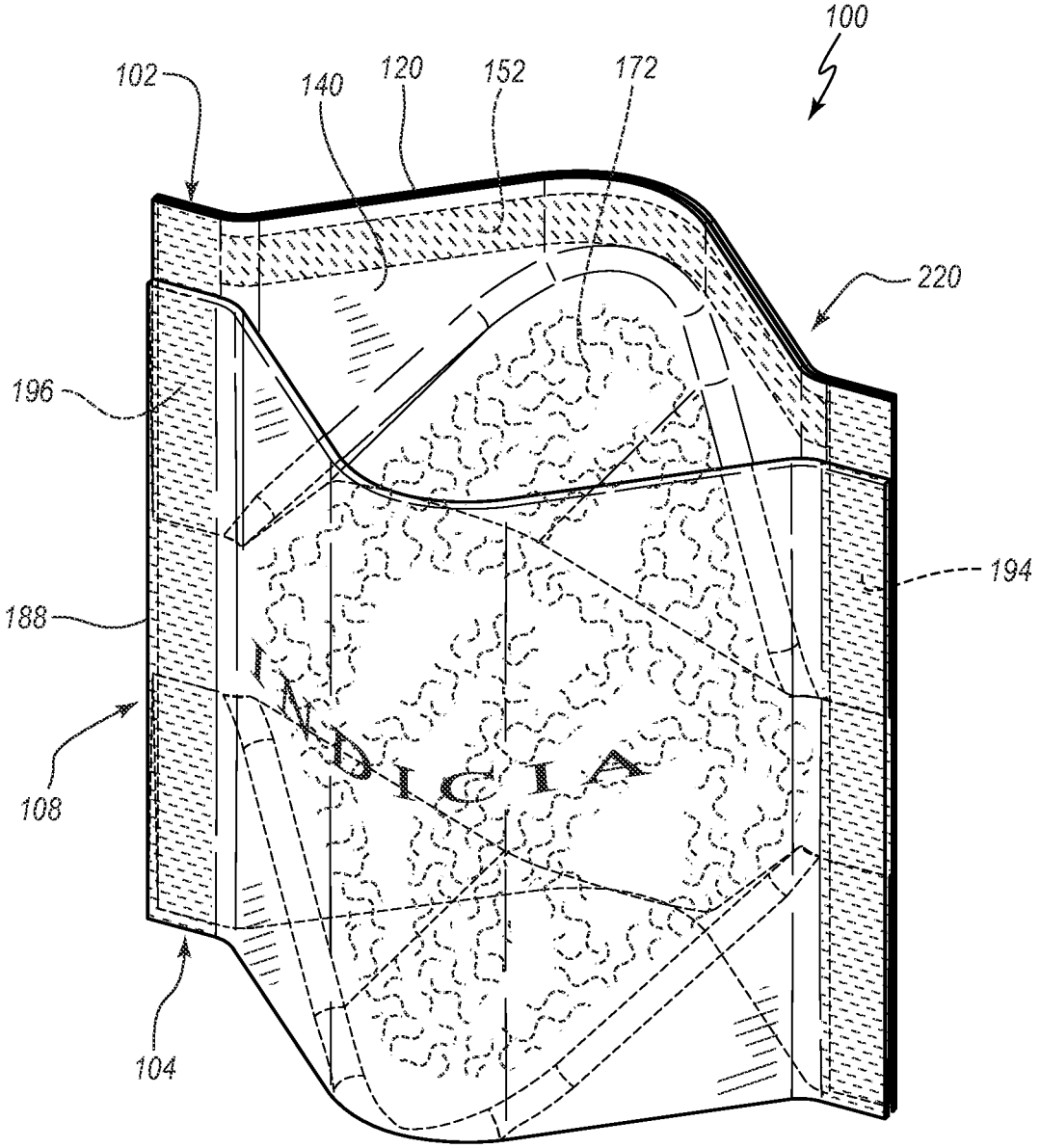
FIG. 8 is a perspective view that depicts a further stage in the formation of a pouch from the segment of material shown in FIG. 4, at which stage a product has been introduced into the partially formed pouch and an additional lock seal has been formed at another lateral end of the segment to seal the pouch closed.

FIG. 8 depicts another stage of the illustrative formation process after the cavity 170 of the pouch 100 has been filled with a food product 172. Once the food product 172 is in place, an additional lock seal 196 can be formed along the lateral end 108 in any suitable manner, and the segment 220 can be cut from the roll stock 205 (FIG. 4). The lock seal 196 extends all the way to the lateral edge 188 of the segment 220, and extends all the way to the edges of the upper and lower ends 102, 104 of the pouch 100. The lock seal 196 can overlap and strengthen a lateral end portion of the heat seal 152.

With continued reference to FIG. 8, in other methods for forming the pouch 100, the lateral seals 194, 196 may be formed before the upper seal 152. For example, in some embodiments, the lateral seal 194, 196 may be formed as the segment 220 is positioned about a forming collar, and an opening can be present between the upper gusset 140 and the rear wall 120. Thereafter, the food product 172 can be introduced into the partially formed pouch 100 and the seal 152 can then be formed. In some methods, the lateral seals 194, 196 and the upper seal 152 can be formed as part of the same process via a single set of equipment, such as an FFS machine. In other methods, the lateral seals 194, 196 can be formed to provide a partially formed pouch, and the pouch may be filled and the upper seal 152 provided by a different set of equipment at a later time and/or a different facility.

Figure 9:
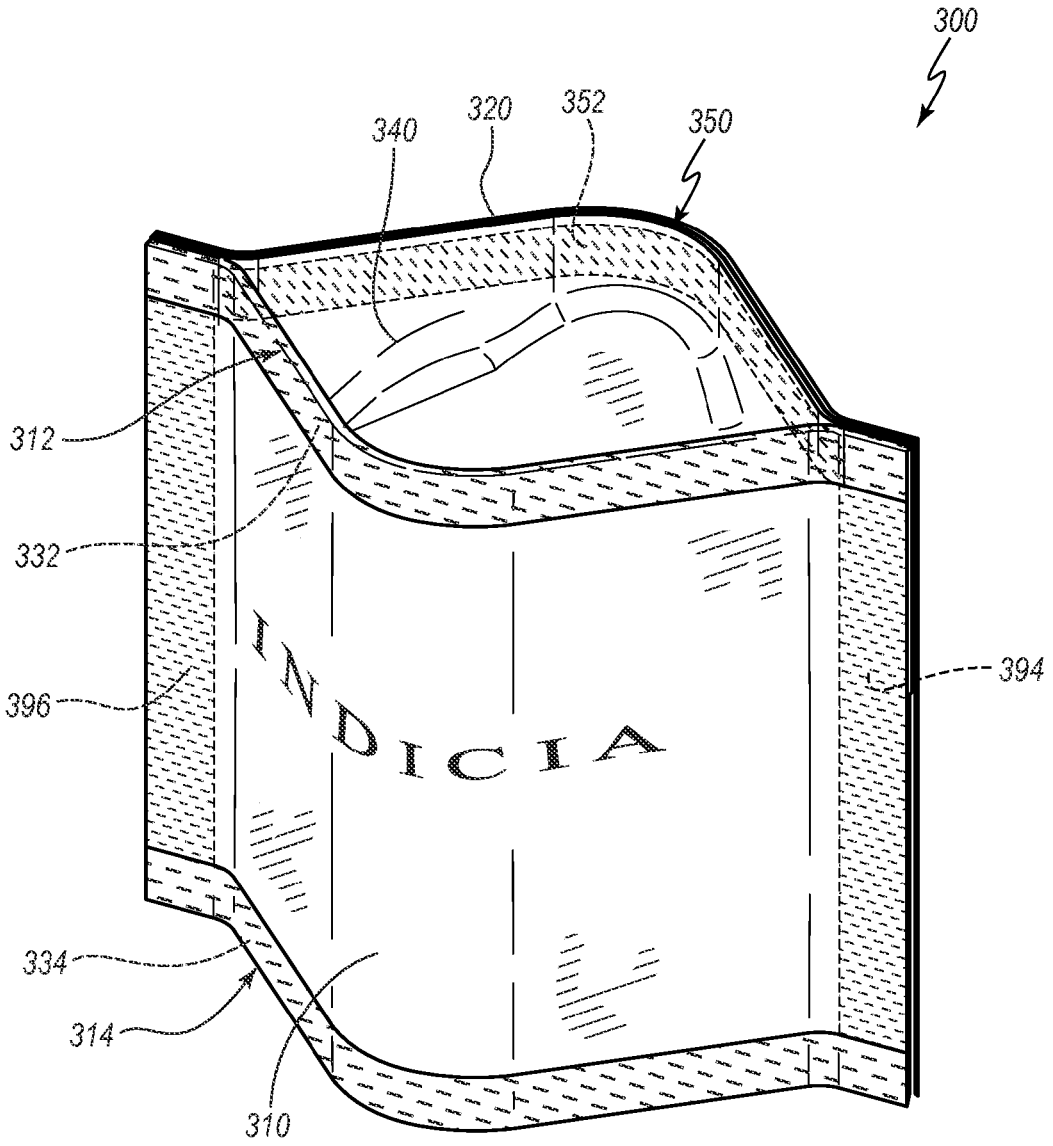
FIG. 9 is a perspective view of another embodiment of a pouch in a sealed state that is devoid of an extension at a seal region at which the pouch is configured to be opened.

FIG. 9 depicts another embodiment of a pouch 300 that can resemble the pouch 100 described above in certain respects. Accordingly, like features are designated with like reference numerals, with the leading digits incremented to "3." Relevant disclosure set forth above regarding similarly identified features thus may not be repeated hereafter. Moreover, specific features of the pouch 300 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the pouch 300. Any suitable combination of the features and variations of the same described with respect to the pouch 100 can be employed with the pouch 300, and vice versa. This pattern of disclosure applies equally to further embodiments depicted in subsequent figures and described hereafter, wherein the leading digits may be further incremented.

The pouch 300 does not include an extension, such as the extension 160 discussed above with respect to the pouch 100. Rather, upper edges of a rear wall 310 and of an upper gusset 340 are at substantially the same height as an upper edge of a front wall 310. Stated otherwise, a seal region 350 can be at approximately the same height as an upper end 312 of the front wall 310.

The pouch 300 can include a peel seal 352 at which the pouch 300 can be opened, and can include lateral seals 394, 396 such as the lock seals 194, 196 discussed above. In some embodiments, the pouch 300 can include additional seals, which can enhance the structural rigidity of the pouch 300. In particular, ancillary seals 332, 334 may be included at the upper end 312 and at a lower end 314 of the front wall 310, respectively. An additional ancillary seal (not shown) may be included at the base of a rear wall 320 of the pouch 300. The ancillary seals may be formed in any suitable manner, and such as by heat sealing, ultrasonic welding, etc. In some embodiments, the pouch 300 may be formed on VFFS equipment having quad seal functionality.

Figure 10B:
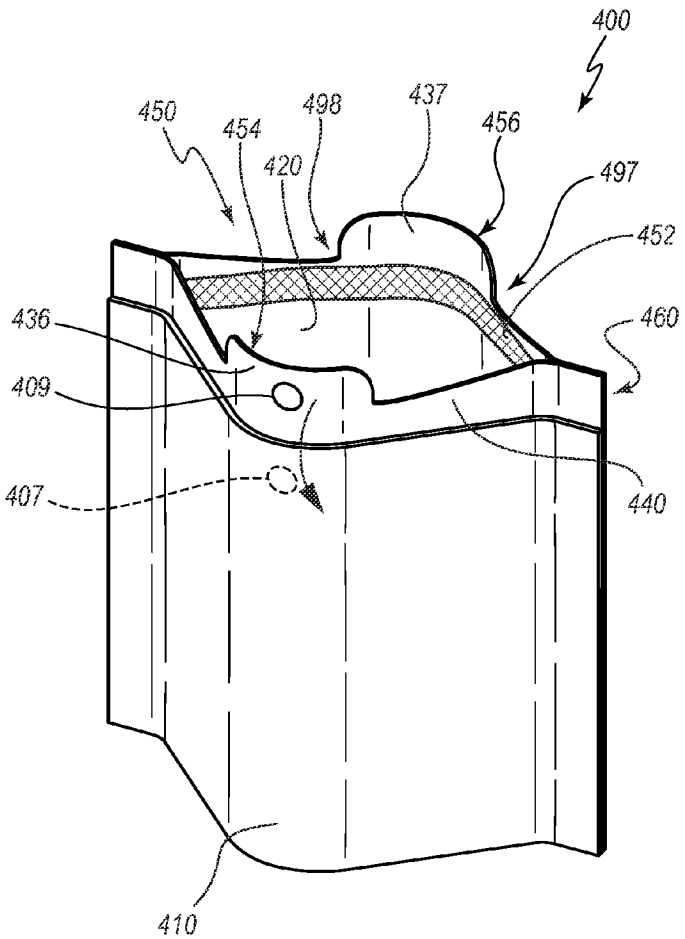
FIG. 10B is another perspective view of the pouch of FIG. 10A in an unsealed state after the discrete grips have been used to open the pouch.
Figure 10A:
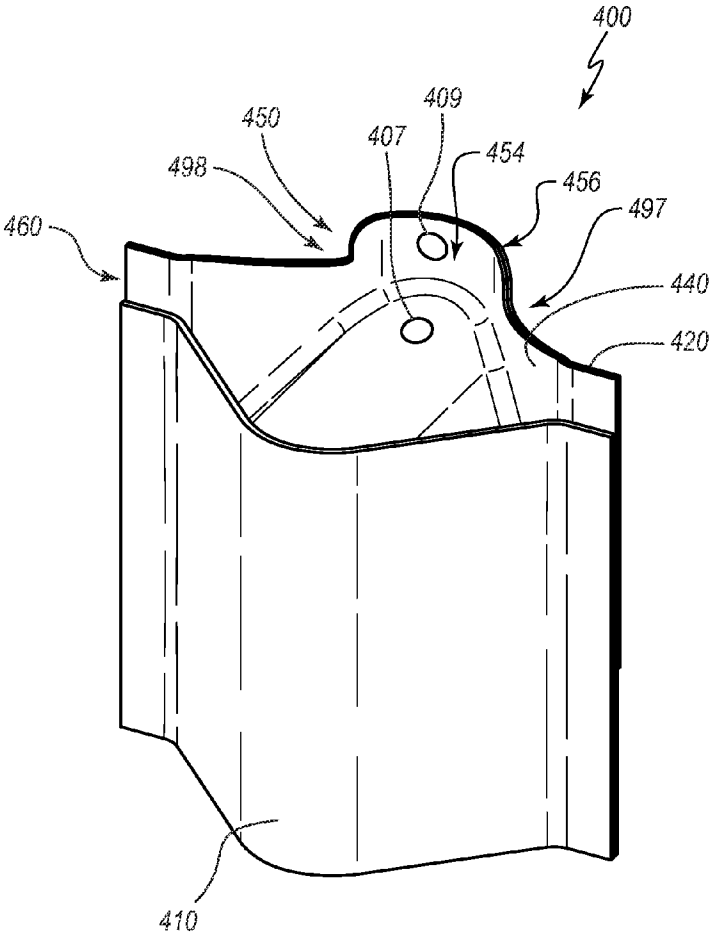
FIG. 10A is a perspective view of another embodiment of a pouch in a sealed state that includes pull tabs having discrete grips.

FIGS. 10A and 10B depict another embodiment of a pouch 400 in a closed or sealed state and in an open state, respectively. The pouch 400 can include an extension 460 such as the extension 160 described above. A seal region 450 of the pouch 400 can include at least a portion of the extension 460.

In some embodiments, the pouch 400 includes pull tabs 454, 456. The pull tabs may include discrete grips 436, 437. For example, in some embodiments, the discrete grips 436, 437 are positioned at a central portion (in in a lateral dimension) of the pouch 400. The discrete grips 436, 437 may be shaped by cutting out notches 497, 498 at the upper ends of a rear wall 420 and upper gusset 440. A seal 452 can extend along a lateral width of the pouch 400 and can be below the notch regions 497, 498, as shown in FIG. 10B.

In some embodiments, the pouch 400 can include one or more attachment features 407, 409 that can aid in maintaining the pouch 400 in an open configuration. In some embodiments, one or more of the attachment features can comprise an adhesive. For example, the adhesive, such as an adhesive tape, may be attached to an outer surface of the upper gusset 440 at one or more of a rearward and forward portion thereof. A pull-strip (not shown) may be included over the adhesive to preserve the adhesive prior to its initial use. In other or further embodiments, one or more of the attachment features can comprise hook-and-pile fasteners (with complementary portions thereof attached at other appropriate portions of the pouch 400).

In some embodiments, the pouch 400 includes the attachment feature 407, which may be an adhesive tape. The attachment feature 407 may be positioned on a rearward portion of the upper gusset 440, as shown in FIGS. 10A and 10B, and/or may be positioned at other portions of the upper gusset 440, such as on the forward portion of the gusset 440. The attachment feature 407 may attach opposing sides of the upper gusset 440 together to maintain the pouch in the open configuration shown in FIG. 10B.

In other or further embodiments, the pouch 400 includes the attachment feature 409, which can be positioned on the pull tab portion 454 of the upper gusset 440, which extends above a front wall 410 of the pouch 400. As shown by an arrow in FIG. 10B, the pull tab 454 can be folded over an upper edge of the front wall 410 and the attachment feature 409 can secure the rearward end of the upper gusset 440 to the front wall 410. Other suitable arrangements are contemplated.

Figure 11:
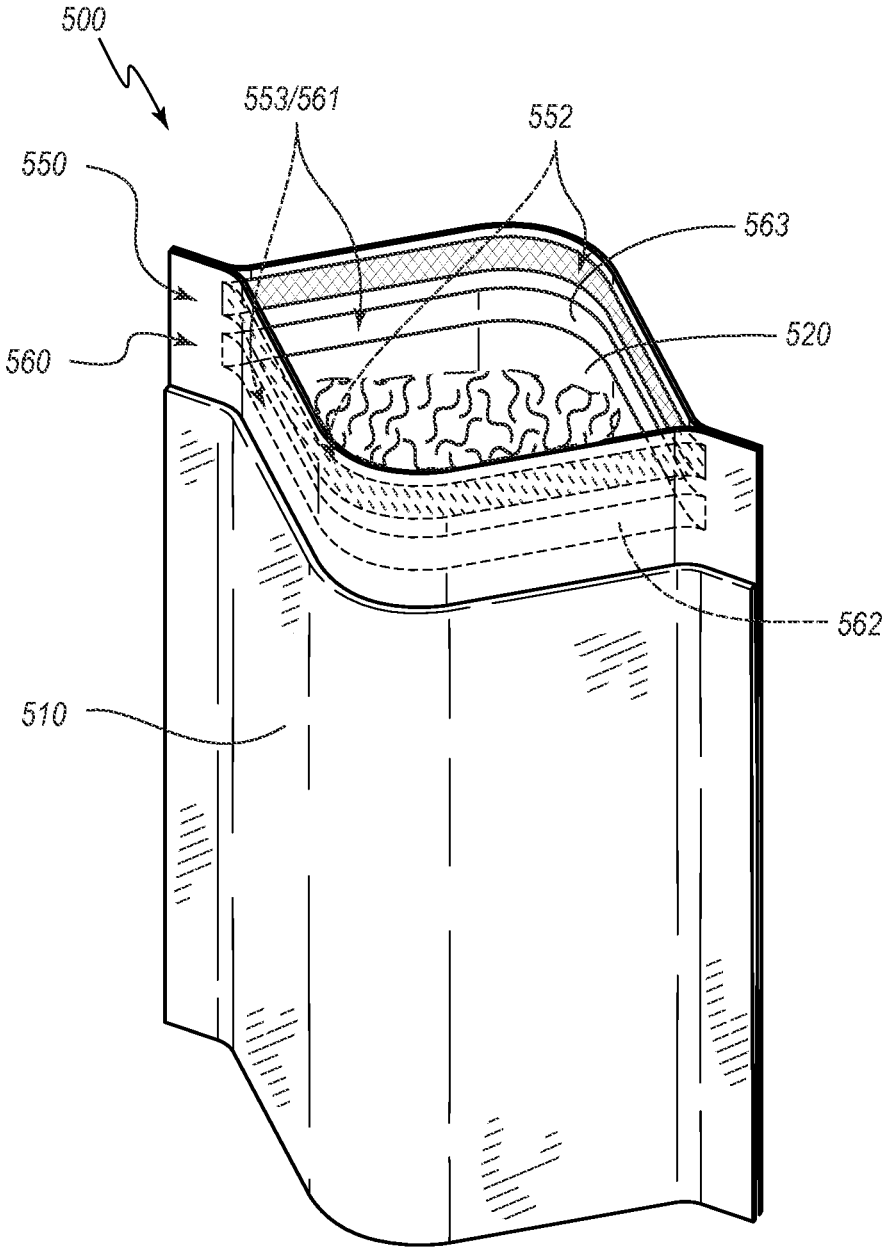
FIG. 11 is a perspective view of another embodiment of a pouch in an open state that includes a zipper within a seal region.

FIG. 11 depicts another embodiment of a pouch 500 having a seal region 550, wherein the pouch 500 is shown in an open state. The seal region 550 can include a zipper 561 capable of forming a reclosable seal 553. In some embodiments, the zipper 561 includes two zipper tracks 562, 563 that are positioned on front and rear walls 510, 520 of the pouch 500, respectively. The zipper tracks 562, 563 can be complementary to each other and configured to engage each other to seal closed the pouch 500.

In other embodiments, the zipper 561 can be replaced with a hook-and-pile, hook-and-hook, or other suitable reclosable system. Accordingly, the zipper tracks 562, 563 can be replaced with complementary connection interfaces that are configured to interact with each other to seal closed the pouch 500. In various embodiments, the reclosable seal 553 formed by the zipper 561 or other reclosable system can be airtight, liquid tight, air pervious, or liquid pervious.

In various embodiments, the reclosable seal 553 can be positioned above or below a non-reclosable seal 552. In the illustrated embodiment, the reclosable seal 553 is positioned below the non-reclosable seal 552. The non-reclosable seal 552 can be a heat seal (e.g., a peel seal) such as described above, and may maintain the reclosable system (e.g., the zipper 561) in a sterile condition prior to use of the pouch 500. In other embodiments, the pouch 500 may include the reclosable seal 553 and omit the non-reclosable seal 552.

In the illustrated embodiment, both the reclosable seal 553 and the non-reclosable seal 552 are positioned within an extension 560. The extension 560 can, in some instances, provide adequate space for inclusion of multiple seals without negatively affecting operation of an upper gusset 540 in opening and closing the pouch 500. In other embodiments, the pouch 500 may be devoid of an extension 560, and may resemble the pouch 300.

Figure 12:
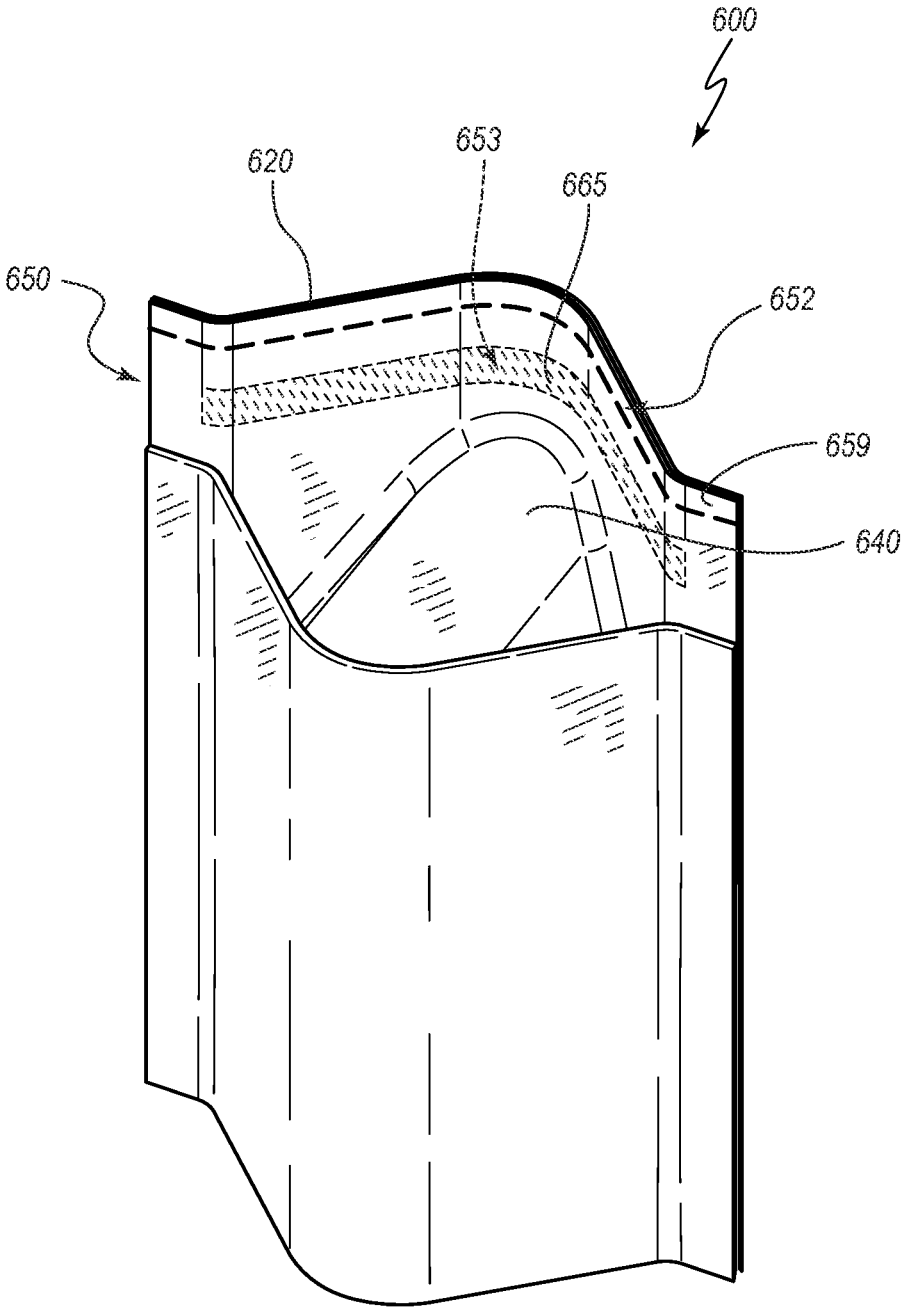
FIG. 12 is a perspective view of another embodiment of a pouch in a sealed state that includes a tear away strip that can be removed from the pouch for initial access to the contents of the pouch.

FIG. 12 depicts another embodiment of a pouch 600 having a seal region 650 that includes a reclosable seal 653, wherein the pouch 600 is shown in a sealed state. The reclosable seal 653 comprises an adhesive strip 665 on a rear wall 620 that is configured to selectively engage with a rearward portion of an upper gusset 640.

In some embodiments, the seal region 650 includes a non-reclosable seal 652 of any suitable variety. In the illustrated embodiment, the non-reclosable seal comprises a tear-away strip 659 that extends along a full lateral width of the pouch 600. The tear-away strip 659 can be removed from the pouch 600 to provide access the contents of the pouch 600, and the reclosable seal 653 can be used thereafter to selectively close and open the pouch 600.

A tear-away strip can similarly be used with embodiments of the pouch 500. Moreover, in other embodiments, a tear-away strip may be the only seal within the seal region 550. Certain of such single-seal embodiments where the seal is completely removed from the pouch can be particularly well suited for single-use pouches.

In some embodiments, the pouches 500, 600 can be shorter than what is depicted in FIGS. 11 and 12. For example, in some embodiments, a ratio of the height of a pouch 500, 600 to its width can be less than what is shown in FIGS. 11 and 12. Certain of such shorter arrangements may be more readily used as a bowl. Other relative configurations are also contemplated.

In various embodiments, a pouch may be configured as a stand-alone package. For example, the pouch may be capable of standing on its own, and may be presented independently or individually on a market shelf. In other embodiments, multiple pouches may be packaged together, such as in shrink-wrap packaging. In still other or further embodiments, one or multiple pouches may be packaged in a box.

Although much of the foregoing disclosure is discussed in the context of packaging for food, it should be appreciated that embodiments of pouches disclosed herein may be used for non-food items. Similarly, pouches of single-use, single-serving, single-portion, or small-quantity packaging as well as pouches of multi-use, multi-serving, multi-portion, or large-quantity packaging are possible. The pouches may be formed in a variety of sizes and configurations. In some instances, some variations in addition to size may exist between the smaller and larger format pouches. For example, in some embodiments, larger format pouches may be formed of a stiffer material. The stiffer material may aid in maintaining the pouch shape and allowing the pouch to stand on its own. The stiffer material also may aid in maintaining the opening in an open state, as a width of the opening can be bigger for the larger format packages, thereby increasing the width of the gusset, which would otherwise tend to make the gusset more pliable. Other alterations are also possible, such as omitting or including various heat seals (e.g., omission or use of quad seal equipment) and/or, where heat seals are present, increasing or decreasing a width of each heat seal.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

References to approximations are made throughout this specification, such as by use of one or more of the terms "about," "approximately," "substantially," and "generally." For each such reference, it is to be understood that, in some embodiments, the value, feature, or characteristic may be specified without approximation. For example, where such a qualifier is used, the terms includes within its scope the qualified word in the absence of the qualifier.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment. Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any embodiment require every feature shown in a particular drawing.

Unless otherwise noted, the terms "a" or "an" are to be construed as meaning "at least one of." In addition, for ease of use, the words "including" and "having" are interchangeable with and have the same meaning as the word "comprising." Recitation of the term "first" with respect to a feature or element does not necessarily imply the existence of a second or additional such feature or element.

The invention claimed is:

1. A pouch comprising:

a first wall having an upper end and a lower end;

a second wall having an upper end and a lower end, the first and second walls cooperating to define at least a portion of a cavity;

a lower gusset extending from each of the first and second walls and defining A lower end of the cavity, wherein the lower gusset is configured to permit the lower ends of the first and second walls to be spaced apart from each other to expand a lower end of the pouch when the cavity is at least partially filled;

an upper gusset extending from the first wall and comprising an interior surface and an exterior surface; and a seal region at an upper end of the pouch that is configured to close the cavity when sealed, wherein at least a portion of the seal region is configured to be sealed to close the pouch in a sealed state, and when the pouch is in the sealed state:

the upper gusset permits the upper ends of the first and second walls to be spaced from each other;

the interior surface of the upper gusset faces an interior of the pouch and defines an upper end of the cavity; and the exterior surface of the upper gusset is at an exterior of the pouch, and wherein unsealing the seal region permits the interior surface of the upper gusset to cooperate with the second wall to define an opening through which contents the cavity can be accessed when the seal region is unsealed;

wherein the pouch is configured to stand on the lower ends of the first and second walls, and wherein the second wall is taller than the first wall such that a lower edge of the seal region is higher than the upper end of the first wall when the pouch stands on the lower ends of the first and second walls.

2. The pouch of claim 1, wherein the upper gusset is configured to collapse and move away from the second wall and toward the first wall when the seal region is unsealed and the opening is expanded.

3. The pouch of claim 2, wherein, when the upper gusset collapses, opposing portions of the exterior surface of the upper gusset are brought closer together.

4. The pouch of claim 2, wherein, when the upper gusset collapses, a pocket defined by the exterior surface of the upper gusset becomes narrower as the opening that is defined in part by the interior surface of the upper gusset becomes larger.

5. The pouch of claim 1, wherein the upper gusset defines a pocket when the pouch is in the sealed state, and wherein, when the seal region is unsealed and the opening is expanded, a portion of the upper gusset serves as a barrier between the pocket and the cavity of the pouch to maintain any debris that is present in the pocket before the seal region is unsealed within the pocket after the seal region is unsealed and the opening is expanded.

6. The pouch of claim 5, wherein the seal region comprises an extension at an end of the upper gusset, and wherein the extension increases a height of the barrier such that the barrier extends beyond an upper edge of the first wall when the opening is fully expanded.

7. The pouch of claim 1, wherein, when the pouch is in the sealed state, the upper gusset extends from each of the first and second walls.

8. The pouch of claim 1, wherein the seal region comprises the upper end of the second wall and an end of the upper gusset.

9. The pouch of claim 1, wherein the seal region comprises an extension at the upper end of the second wall.

10. The pouch of claim 9, wherein the seal region further comprises an extension at an end of the upper gusset, wherein the extensions at the ends of the gusset and second wall are attached to each other when the pouch is in the sealed state.

11. The pouch of claim 1, wherein the seal region comprises a sealed peelable sealant layer.

12. The pouch of claim 1, wherein the seal region is reclosable.

13. The pouch of claim 12, wherein the seal region comprises a tear-away portion that is configured to be removed from the pouch.

14. The pouch of claim 1, wherein the seal region comprises one or more pull tabs that aid in separating portions of the seal region from each other after the seal region has been sealed.

15. The pouch of claim 1, wherein the first and second walls and the upper and lower gussets are defined by a unitary piece of material.

16. The pouch of claim 15, wherein the unitary piece of material is attached along its lateral ends to form lateral ends of the pouch that extent between the upper and lower ends of the first and second walls, and wherein two opposing longitudinal ends of the unitary piece of material define at least a portion of the seal region.

17. The pouch of claim 16, wherein the second wall is adjacent to the portion of the seal region that is defined by one of the two opposing longitudinal ends of the unitary piece of material and the upper gusset is adjacent to the portion of the seal region that is defined by the other of the two opposing longitudinal ends of the unitary piece of material.

18. The pouch of claim 1, wherein the first and second walls are attached to each other along lateral ends thereof.

19. The pouch of claim 1, further comprising an attachment feature attached to the upper gusset, wherein the attachment feature is configured to attach one portion of the upper gusset to another portion of the upper gusset to maintain the opening in an expanded state.

20. The pouch of claim 1, further comprising an attachment feature attached to the upper gusset, wherein the attachment feature is configured to attach one portion of the upper gusset to the first wall to maintain the opening in an expanded state.

21. The pouch of claim 1, wherein the seal region comprises both a reclosable seal and a non-reclosable seal.

22. A pouch comprising:

a first wall having an upper end and a lower end;

a second wall having an upper end and a lower end, the first and second walls cooperating to define at least a portion of a cavity;

a lower gusset extending from each of the first and second walls and defining a lower end of the cavity, wherein the lower gusset is configured to permit the lower ends of the first and second walls to be spaced apart from each other to expand a lower end of the pouch when the cavity is at least partially filled;

an upper gusset extending from the first wall; and a seal region at an upper end of the pouch that is configured to close the cavity when sealed, wherein at least a portion of the seal region is configured to be sealed to close the pouch in a sealed state, and when the pouch is in the sealed state, the upper gusset defines a pocket between the first and second walls, wherein, unsealing the seal region yields an opening through which contents of the cavity can be accessed and a portion of the upper gusset serves as a barrier between the pocket and the cavity of the pouch to maintain any debris that is present in the pocket before the seal region is unsealed within the pocket after the seal region is unsealed and the opening is expanded;

wherein the seal region comprises an extension at an end of the upper gusset, and wherein the extension increases a height of the barrier such that the barrier extends beyond an upper edge of the first wall when the opening is fully expanded, and wherein the upper edge of the first wall is at a height that is below a lower edge of the seal region when the pouch is standing on the lower ends of the first and second walls.

23. The pouch of claim 22, wherein, when the seal region is unsealed, an integrity of one or more materials of which the upper gusset is formed is maintained to prevent any contents of the pocket from passing through the one or more materials of the upper gusset into the cavity of the pouch.

* * * * *